United States Patent [19]

Neuendorf et al.

[11] 4,026,658

[45] May 31, 1977

[54] AUTOMATIC SUPPORT SYSTEM FOR A SCREED

[75] Inventors: Arthur August Neuendorf, Big Rock; Kendall Jay Rudolph, Aurora, both of Ill.

[73] Assignee: Barber-Greene Company, Aurora, Ill.

[22] Filed: July 26, 1974

[21] Appl. No.: 492,360

[52] U.S. Cl. ..... 404/84

[51] Int. Cl.[2] ..... E01C 19/00

[58] Field of Search ..... 404/118, 106, 84, 119, 404/83; 37/DIG. 1, DIG. 13, DIG. 20, 117.5

[56] References Cited

UNITED STATES PATENTS

| | | | |
|---|---|---|---|
| 2,591,502 | 4/1952 | Bohannan | 404/84 |
| 2,973,723 | 3/1961 | Hudis | 404/106 X |
| 3,015,258 | 1/1962 | Apel | 404/106 |
| 3,043,201 | 7/1962 | Maxon | 404/106 |
| 3,137,219 | 6/1964 | Hudis | 404/119 |
| 3,403,609 | 10/1968 | Bradshaw | 404/118 X |
| 3,533,336 | 10/1970 | Wikel | 404/118 X |
| 3,533,337 | 10/1970 | Swisher | 404/118 X |
| 3,559,543 | 2/1971 | Schwoebel | 404/118 X |

*Primary Examiner*—Nile C. Byers, Jr.
*Attorney, Agent, or Firm*—Clarence J. Fleming

[57] ABSTRACT

An asphalt finishing machine includes a tractor and a screed of the free floating type wherein the latter is towed behind the tractor by a pair of draft arms pivotally connected at their forward ends to the frame of the tractor. A pair of hydraulic cylinders is connected to the tractor and to the screed for lifting the latter away from the roadway mat when the finishing machine is transported from one job site to another. A control system is connected with these cylinders and is automatically and instantaneously brought into operation, by means of a pressure-sensitive switch, whenever forward motion of the finishing machine is arrested, as when the hopper is being refilled, for actuating the hydraulic cylinders to develop a lifting force having a magnitude at least 80 to 90% of the force developed by the dead-weight of the screed thereby to prevent the screed from settling into the mat during such periods of time when forward motion of the finishing machine is stopped.

10 Claims, 3 Drawing Figures

AUTOMATIC SUPPORT SYSTEM FOR A SCREED

BACKGROUND OF THE INVENTION

1. Field of the Invention

The field of the present invention relates to finishing machines of the types including a tractor and a screed towed by such tractor. More particularly, the field of invention relates to asphalt finishing machines having screeds of the free floating or self-leveling type.

2. The Prior Art

As is known to those skilled in the art, such screeds are towed behind the tractor by a pair of draft arms, the latter being pivotally connected at their forward ends to the frame of the tractor. As the screed is pulled into the material deposited on the subgrade by the forwardly moving tractor, the screed will automatically seek a level where the bottom of the screed becomes parallel to the direction of pull of the pivot points of the leveling arms. This type of screed operation depends upon time, distance and mix stability; properly utilized, such a screed can produce a smooth and level mat over a rough sub-base.

A finishing machine of the type under consideration includes a hopper at its forward end which must be replenished from time to time from a truck carrying the supply of asphalt. In order to to refill the hopper, forward motion of the finishing machine is temporarily arrested to permit the truck to come into position for dumping its contents into the hopper of the finishing machine. When the finishing machine is stopped, the full weight of the stationary screed comes to rest on the incompletely compacted asphalt material. Under these conditions, the screed will sink into the freshly laid material thereby creating an unsightly mark on the surface of the roadway.

Quite often, the screed will sink into the mat to such an extent that an undesirable depression will be formed in the surface of the roadway mat. When forward motion of the paving machine is resumed, the attitude of the screed will cause it to rise slightly above its desired free floating level and this will in turn cause a hump to be formed on the roadway mat adjacent the aforementioned mark or depression. This undesirable result obtains because the screed overshoots the desired level before it achieves self-leveling thus aggravating the aforedescribed situation which causes formation of a hump on the surface of the roadway mat.

As is also known to those skilled in the art, screeds of the type under consideration are often provided with automatic screed control systems. These automatic systems control the screed level to establish grade lines and for matching adjacent mats or gutters. For a detailed description of such a system, reference may be had to U.S. Pat. No. 3,285,148, in the name of J.M. Munyon, and assigned to the assignee of the present invention. These automatic systems control the angle of attack of the screed, as by raising or lowering the pivot points at the forward ends of the draft arms, and use various methods of obtaining grade references, such as a reference stringline to grade, a joint matching shoe referencing to an adjacent mat or a long ski which moves with the finisher and acts as a traveling straight edge.

With the use of a finishing machine having a free floating screed and an automatic screed control system as just referred to, the screed will still settle into the freshly laid mat when forward motion of the paver is arrested for refilling the hopper. When forward motion of the finishing machine is resumed, the sensing system forming part of the automatic screed control system will sense that the screed is somewhat below the desired level of the roadway mat. This sensing action will cause the automatic control sytem to raise the tow points of the draft arms until the screed regains the desired level; however, such action will usually aggravate formation of the undesired hump referred to above, because the automatic screed control system will cause the screed to overshoot to some extent before it attains the predetermined level.

SUMMARY AND OBJECTS OF THE INVENTION

The present invention may be summarized as relating to a system which is automatically and instantaneously brought into operation whenever forward movement of the finishing machine is arrested, and which will apply a lifting force to the screed thereby to prevent the latter from settling into the roadway mat during the period of time when the finishing machine is stopped.

A primary object of the present invention is the provision of new and improved means for preventing a screed of the free floating type from settling into the mat when forward motion of the finishing machine is arrested.

Another object of the present invention is the provision of new and improved means in a finishing machine of the type described and which means are automatically and instantaneously brought into operation whenever forward motion of the paver is arrested.

Still another object of the present invention is the provision of the aforesaid automatic means utilizing fluid operated cylinders which are connected to the tractor and to the screed, and which cylinders are controlled by fluid pressure sensing means for actuating the cylinders to develop a lifting force on the screed having a magnitude which is at least 80% to 90% of the downward force acting on the screed resulting from the dead-weight of the latter.

Still another object of the present invention is the provision of the various means set forth in the foregoing object and wherein such cylinders are also used to lift the screed away from the surface of the roadway mat and to a transport position thereby adapting the finishing machine to be readily moved from one job site to another.

These and other objects and advantages of the invention will become apparent from the following specification disclosing a preferred embodiment shown in the accompanying drawings.

DESCRIPTION OF A PREFERRED EMBODIMENT

Figure 1:
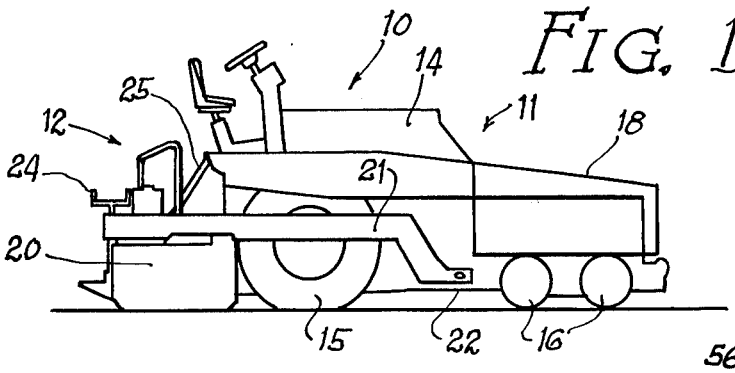
FIG. 1 is a side elevational view of a finishing machine embodying the present invention.

Referring to FIG. 1, a roadway finishing machine, such as an asphalt paving machine, is generally designated 10. Although the present invention has particular applicability in an asphalt finishing machine, it will be understood that the invention is not to be so limited; the invention may be used in other types of finishing machines which form a roadway mat from particulate material.

The finishing machine 10 includes a tractor unit, generally designated 11, and a screed unit, generally designated 12. The tractor includes a frame or chassis 14 supported by a pair of large, driven rear wheels, one being shown and designated 15 and by forward pairs of wheels, one pair being illustrated and designated 16. These wheels are of the rubber-tire type. Of course the invention has equal applicability with tractors which are supported by endless tracks.

A suitable propulsion system, including an internal combustion engine, is provided for powering the rear wheels 15. The tractor includes a hopper 18 at its forward end for receiving the supply of roadway material, such as asphalt.

The screed unit 12 includes a screed 20 connected to a pair of draft arms, one draft arm being illustrated and designated 21. The forward ends of the draft arms are pivotally connected to the frame or chassis 14, as at 22. Preferably, the asphalt finishing machine 10 includes an automatic speed control system; to this end, powered, usually in the form of hydraulic cylinders (not shown), are connected to the forward ends of the draft arms to raise and lower the pivot points 22 thereby to vary the angle of attack of the screed in turn to control the thickness of the roadway mat, all well known to those skilled in the art. The angle of attack of the screed may also be varied by pivoting the screed 20 relative to the draft arms — the usual manually operated screws are provided for this purpose, one being illustrated and designated 24.

A pair of hydraulic cylinders 25 (also see FIG. 2) is provided for raising and lowering the screed unit 12 relative to the tractor 11. Each of these hydraulic cylinders is pivotally connected at its opposite ends to the chassis 14 of the tractor and to the screed 20. Such cylinders are used to lift the screed substantially above the elevation of the roadway mat to facilitate transport of the finishing machine from one job site to the other.

The various components of the asphalt finishing machine heretofore described and referred to and the other components thereof not specifically referred to herein are well known to those skilled in the art and of themselves form no part of the present invention. For a more detailed explanation of such a finishing machine and particularly the automatic screed control system therefore, reference may be had to the aforementioned Munyon patent.

Figure 2:
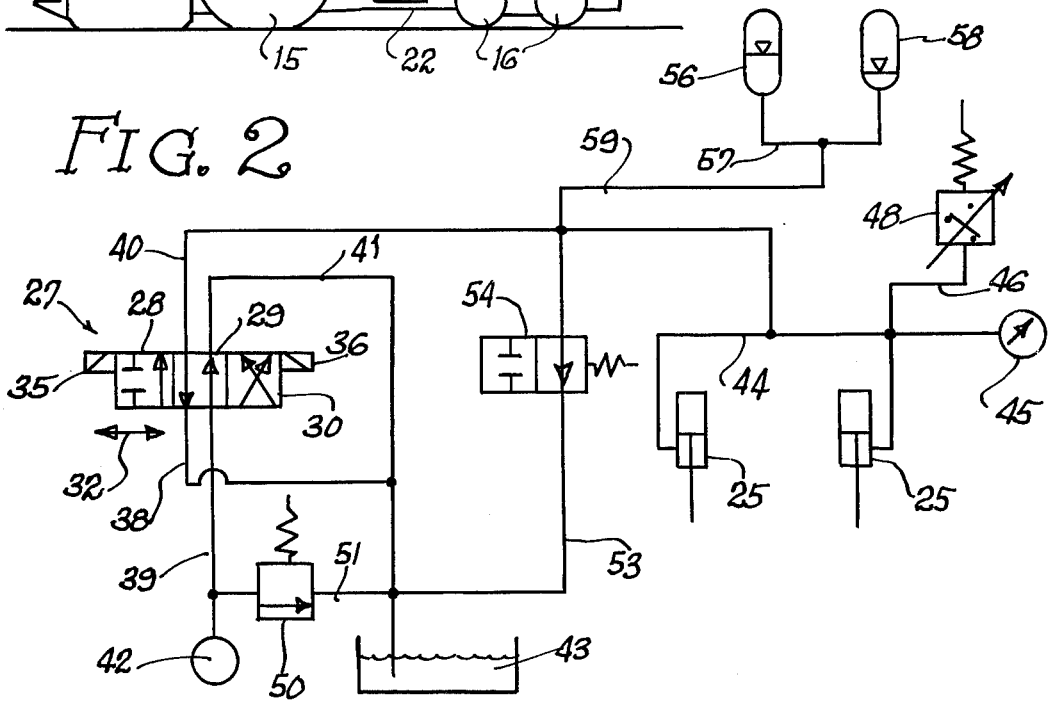
FIG. 2 is a hydraulic diagram; largely schematic in form, and showing the present invention.

Referring now to FIG. 2, a hydraulic circuit includes a solenoid operated valve, generally designated 27. This valve includes a "hold" section 28, a "neutral" section 29, and an "up" section 30. It will be understood that the valve is mounted for reciprocal sliding movement in the direction of the double arrows 32. This valve is operated by a solenoid, generaly designated 34 (FIG. 3), which solenoid includes windings or coils 35, 36.

When the solenoid 34 is de-energized, the valve will be in the position schematically illustrated in FIG. 2 with its neutral section 29 in communication with the hydraulic lines 38, 39, 40 and 41. When the winding 35 is energized, the valve 27 is actuated for placing the hold section 28 in communication with the aforementioned hydraulic lines; when the winding 36 is actuated, the valve 27 is shifted in the other direction for placing the up section 30 in alignment with these hydraulic lines.

A hydrauic pump 42 is connected with the line 39. A hydraulic tank or reservoir 43 is placed in communication with the line 41. The hydraulic line 40 connects with a line 44, the latter extending to both of the hydraulic cylinders 25. Preferably, the line 44 is connected with a pressure gauge 45. The line 44 is connected with another hydraulic line 46, the latter being connected to an adjustable pressure switch 48.

A pressure relief valve 50 is connected in a line 51 extending between the hydraulic lines 39 and 41. The line 51 also communicates with another line 53 which extends to a dump valve 54, the latter being controlled by a solenoid 55.

A hydraulic accumulator 56 is connected to a hydraulic line 57. Another hydraulic accumulator 58 is also connected to the hydraulic line 57. The line 57 communicates with a line 59, the latter being in communication with the lines 40 and 53.

Figure 3:
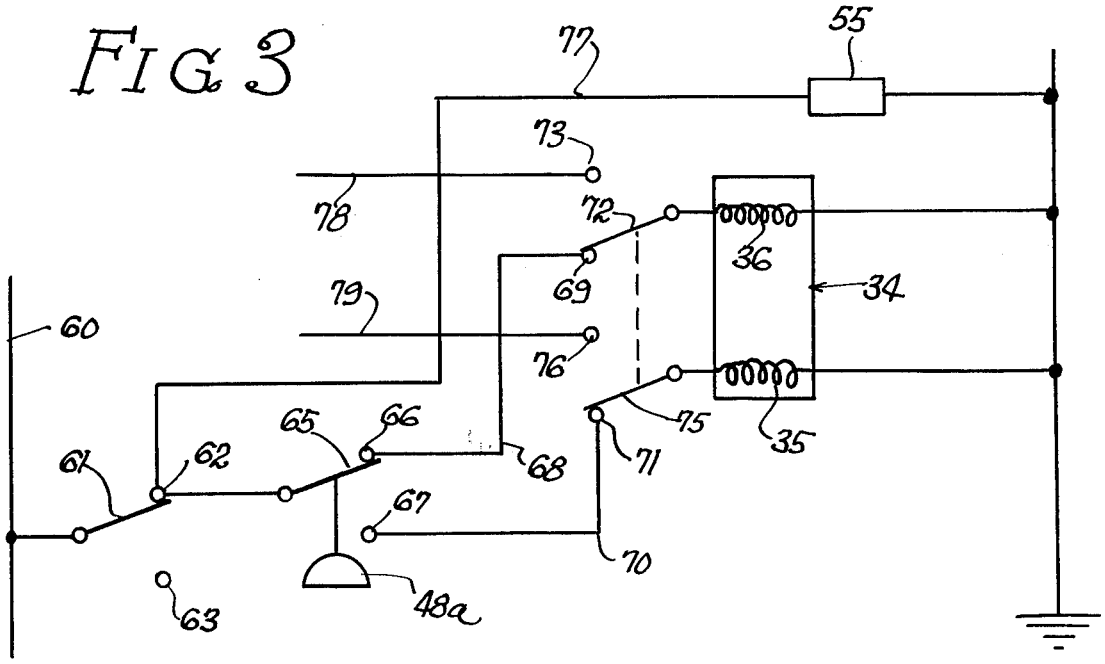
FIG. 3 is an electrical, schematic showing the present invention.

The motor or propulsion unit for the tractor 11 is preferably provided with an electrically operated speed control system whereby the desired speed of forward travel of the machine may be selected and automatically maintained; such systems are known to those skilled in the art. Referring to FIG. 3, an electrical conductor 60 forming part of such a speed control circuit is connected to the movable member 61 of a stop-start switch having a "stop" terminal 62 and a "start" terminal 63. The start terminal 63 is of course connected with other circuit means (not shown) forming part of the automatic speed control system as just mentioned.

The actuating member 48*a* of the adjustable pressure switch 48 is connected to the movable member 65 of a pressure switch having first and second terminals 66, 67. An electrical conductor 68 connects the terminal 66 with a terminal 69; similarly, a conductor 70 connects the terminal 67 with a terminal 71.

A movable switch member 72 is adapted for alternate contact with the terminal 69 and another terminal 73. The switch member 72 is mechanically connected to another switch member 75, the latter being adapted for alternate contact with the terminal 71 and a terminal 76. The switch member 72 is electrically connected to the solenoid winding 36; switch member 75 is electrically connected to the solenoid winding 35.

The circuit shown in FIG. 3 includes a conductor 77 connecting the stop terminal 62 to ground through the solenoid 55. The terminals 73, 76 are connected with conductors 78, 79, respectively, which conductors are connected with a screed hoist switch (not shown); such switch is actuated when it is desired to lift the screed completely away from the roadway mat to facilitate transport of the finishing machine 10 from one job site to another.

It will be understood that the adjustable pressure switch 48, which is of well known construction, is preferably set to actuate at a pressure which is 50 to 75 pounds per square inch less than the pressure required to lift the screed. As will become apparent herein, setting the adjustable pressure switch at such a pressure will result in 80 to 90% of the weight of the screed being lifted from the mat during operation of the present invention. When this preset pressure is reached, the actuator 48*a* will operate to move the switch member 65 from the terminal 66 to the terminal 67.

When the asphalt finishing machine 10 is moving forwardly during a paving operation, the switch member 61 will of course be in contact with the start terminal 63. When the operator desires to stop forward motion of the paver, as for refilling the hopper 18 from a truck containing asphalt material, the switch member 61 is placed into contact with the stop terminal 62. This will cause the solenoid winding 36 to be energized for shifting the valve 27 thereby to place the up section 30 in communication with the hydraulic lines 38–41.

Thus, immediately upon movement of the switch member 61 to the stop terminal 62, the cylinders 25 will be pressurized to commence the development of an upward lifting force on the screed 20. When the fluid pressure in the system reaches the preset pressure determined by the pressure setting of the adjustable switch 48, the actuator 48*a* will operate to move the switch member 65 away from the terminal 66 and into contact with the terminal 67. This movement of the switch member 65 will cause the solenoid winding 35 to be energized and the winding 36 to be de-energized thereby shifting the valve 27 for placing the hold section 28 in communication with the hydraulic lines 38–41. As a consequence of this movement of the valve 27, the upward lifting force on the screed, which has a magnitude of 80 to 90% of the total downward force represented by the dead-weight of the screed, will be maintained. Since substantialluy the entire weight of the screed is thus carried or supported by the cylinders 25, the screed will not be allowed to settle into the freshly laid mat.

After the hopper 18 has been refilled, forward motion of the paver is commenced by moving the switch member 61 to the start terminal 63 whereupon the winding 35 will be de-energized allowing the valve 27 to be returned to its neutral position, under the influence of biasing means (not shown), with the section 29 in alignment with the various hydraulic lines 38–41. Accordingly, it is seen that whenever forward motion of the paver is arrested, the cylinders 25 will be automatically and substantially instantaneously pressurized at the preset level to prevent the screed from settling into the mat.

The accumulators 56, 58 are provided to assist in cushioning the surge from the pump 42 during actuation of the valve 27, to compensate for any leakage in the hydraulic system, and to maintain the pressure in the system substantially constant. Preferably, each accumulator has a half-gallon capacity with one of the accumulators being charged to approximately 200 pounds per square inch and the other accumulator charged to approximately 600 pounds per square inch. Since the accumulators must be charged each time the finishing machine is stopped, the length of time to charge the accumulators can be critical. Needless to say, the cylinders 25 must be actuated immediately upon arresting forward motion of the screed to prevent settling of the screed into the mat. The use of two accumulators with relatively small capacities and differentially charged as described above achieves fast charging with a relatively low pressure change per unit volume at high pressures.

Accordingly, it is seen that the present invention provides a new and improved means from preventing the screed from settling into the freshly laid mat when forward motion of the machine is arrested. The embodiment shown for purposes of illustration makes advantageous use of the cylinders 25 which are also employed to lift the screed completely away from the mat when the asphalt paver is to be moved from one job site to another site. When it is desired to lift the screed to its transport position, the switch members 72, 75 are placed into contact with the terminals 73, 76, respectively, whereupon the aforementioned hoist switch (not shown) may be actuated for lifting the screed to the desired elevation above the roadway mat. It should be understood that the present invention is not to be limited for use with the cylinders which are employed to lift the screed. For example, separate cylinders may be provided and associated with pads for engaging the subgrade adjacent the mat thereby to prevent the screed from settling into the freshly laid mat.

It should also be understood that the invention is not to be limited to setting the adjustable pressure switch 48 to develop a lifting force having a magnitude of 80 to 90% of the downward force developed by the dead-weight of the screed. Although such setting represents a preferred form of the invention, it is within the scope of the invention to present the adjustable pressure switch at a somewhat lesser value and still result in the development of an upward lifting force having a magnitude sufficient to prevent the screed from settling into the mat to an objectionable degree.

We claim:

1. In a roadway finishing machine of the type including a tractor and a floating screed, wherein the screed is connected to the tractor by a pair of longitudinally extending draft arms pivotally connected at their forward ends to the tractor such that the screed is towed behind the tractor for self-leveling thereby to form a roadway mat, the improvement comprising:
   a. propulsion means for said tractor;
   b. a first control system for said propulsion means including a "stop-start" actuator;
   c. powered lifting means connected to said screed for lifting the latter;
   d. a second control system connected with said powered lifting means for actuating the latter to develop a lifting force having a magnitude which is at least 80 to 90% of the downward force developed by the dead-weight of the screed; and
   e. automatic actuating means operatively connected with said first and second control systems and responsive to actuation of said stop-start actuator to its stop position thereby to activate said second control system, whereupon said screed is prevented from settling into the mat when forward motion of said tractor is arrested.

2. The improvement according to claim 1 further defined by other actuating means connected with said powered lifting means for actuating the latter, independently of said automatic actuating means, to lift the screed away from the mat and to a transport position.

3. The improvement according to claim 1 wherein said powered lifting means include hydraulic cylinders.

4. The improvement according to claim 3 wherein said hydraulic cylinders are connected to said screed and to said tractor.

5. In a roadway finishing machine of the type including a tractor and a floating screed, wherein the screed is connected to the tractor by a pair of longitudinally extending draft arms pivotally connected at their forward ends to the tractor such that the screed is towed behind the tractor for self-leveling thereby to form a roadway mat, the improvement comprising:
   a. a propulsion means for said tractor;
   b. a first control system for said propulsion means including a stop-start actuator;

c. powered lifting means including fluid operated cylinders connected to said tractor and to said screed for lifting the latter;

d. a second control system connected with said powered lifting means for actuating said cylinders thereby to lift the screed away from the mat and to a transport position; and e. said second control system including automatic actuating means operatively connected with said cylinders to develop a lifting force having a magnitude which is at least 80 to 90% of the downward force developed by the dead-weight of the screed, said automatic actuating means being connected with said first control system and responsive to actuation of said stop-start actuator to its stop position thereby to actuate said cylinders, whereupon said screed is prevented from settling into the mat when forward motion of the tractor is arrested.

6. The improvement according to claim 5 further defined by:

a. said stop-start actuator being in the form of an electric switch having start and stop terminals;

b. said second control system including a valve connected with said cylinders and having hold and up positions, said second control system having a solenoid for shifting said valve back and forth between the aforesaid positions; and c. said automatic actuating means including a fluid pressure operated switch and a circuit connecting the latter with said stop terminal.

7. The improvement according to claim 6 wherein said second control system includes a hydraulic accumulator connected between said valve and said cylinders.

8. In a roadway finishing machine of the type including a tractor and a floating screed, wherein the screed is connected to the tractor by a pair of longitudinally extending draft arms pivotally connected at their forward ends to the tractor such that the screed is towed behind the tractor for self-leveling thereby to form a roadway mat, the improvement comprising:

a. propulsion means for said tractor;

b. a first control system for said propulsion means including a stop-start actuator;

c. powered lifting means connected to said screed for lifting the latter;

d. a second control system connected with said powered lifting means for actuating the latter to develop a lifting force having a magnitude which constitutes a substantial percentage of the magnitude of the downward force developed by the dead-weight of the screed; and e. automatic actuating means operatively connected with said first and second control systems and responsive to actuation of said stop-start actuator to its stop position thereby to activate said second control system, whereupon said screed is prevented from settling into the mat when forward motion of said tractor is arrested.

9. The improvement according to claim 8 wherein said percentage is approximately in the range of 80 to 90%.

10. A paving machine movable along the ground and operable to form a smooth mat from paving material deposited on the ground, said machine comprising a frame, and an elongated screed mounted on said frame for up and down floating movement and supported vertically by said material during movement of said machine, the improvement in said machine comprising, first control means on said frame for automatically detecting stopping of said machine, and second control means on said frame and responsive to said first control means for applying a force to said screed to limit downward floating of said screed in response to stopping of the machine and thereby restrict sinking of said screed into said material when said machine is stopped, said second control means being operable to allow vertical floating of the screed when said machine is moving.

* * * * *